United States Patent [19]

Taddeo et al.

[11] 3,953,788

[45] Apr. 27, 1976

[54] AC POWER SOURCE WITHOUT A STEP-UP OUTPUT TRANSFORMER

[75] Inventors: Fausto V. Taddeo; Raymond W. Pauly, both of San Gabriel, Calif.

[73] Assignee: Pacific Electronic Enterprises, Inc., Rosemead, Calif.

[22] Filed: Apr. 14, 1975

[21] Appl. No.: 568,017

[52] U.S. Cl. ..... 323/25; 307/127; 321/11; 321/45 R

[51] Int. Cl.[2] ..... G05F 1/44

[58] Field of Search ..... 321/2, 11, 45 R; 323/23, 25; 317/16, 33 R, 33 VR; 307/127; 330/15, 17, 22

[56] References Cited

UNITED STATES PATENTS

| | | | |
|---|---|---|---|
| 3,483,425 | 12/1969 | Yanishevsky | 323/25 X |
| 3,490,028 | 1/1970 | Modiano | 321/2 |
| 3,566,292 | 2/1971 | Nercessian et al. | 330/15 |
| 3,801,858 | 4/1974 | Grangaard et al. | 323/23 X |
| 3,818,361 | 6/1974 | Gonda | 330/15 X |

*Primary Examiner*—Gerald Goldberg
*Attorney, Agent, or Firm*—Lindenberg, Freilich, Wasserman, Rosen & Fernandez

[57] ABSTRACT

An AC power source characterized by the absence of a step-up output transformer is disclosed. The power source, which includes first and second output terminals across which a load is connected, is designed to provide AC power at a desired output voltage, e.g., 130v rms up to a desired current rating, e.g., 8 amperes. The source includes a first unit which includes a first voltage amplifier associated with positive and negative current amplifiers of substantially unity voltage gain, which provide power at the first output terminal up to the rated current at a voltage of 65v rms. Direct feedback is provided to the first voltage amplifier from the first output terminal, to which the load is connected. The source includes a second unit identical to the first unit, which includes a second voltage amplifier associated with positive and negative current amplifiers of substantially unity voltage gain, which provide power at the second output terminal up to the rated current at a voltage of 65v rms. The voltages at the two output terminals are 180° out of phase so that the voltage across the two terminals is 130v rms. Direct feedback is provided to the second voltage amplifier from the second output terminal. The current amplifiers include transistors which are connected in parallel and commonly driven and protective means to protect the transistors due to a short-type failure of one of them. The power source may include several current-amplifier modules connected in parallel between the two voltage amplifiers and the two output terminals. Any defective module is replaceable without the interruption of power supply to the load as long as one of the modules functions properly.

14 Claims, 5 Drawing Figures

AC POWER SOURCE WITHOUT A STEP-UP OUTPUT TRANSFORMER

BACKGROUND OF THE INVENTION

1. Field of the Invention

The present invention relates to AC power sources and, more particularly, to a solid state AC power source which is characterized by the absence of an output transformer.

2. Description of the Prior Art

In prior art solid state AC power sources, in order to eliminate the type of failure of output transistors, known as "second-breakdown", power is first generated at a relatively low voltage by means of the power amplifier section, so that the transistors are below their second-breakdown failure region. This region varies with transistor type. Generally in the prior art the maximum voltage seen by the transistors is kept below 150–200 volts which is below the second breakdown failure region for most types of transistors. Thus, in the prior power source the AC power, which is generated by the power amplifiers, is always below 125v–130v rms which is usually required for most power sources. The lower than required output voltage is increased by stepping up the voltage of the generated power by means of an output step-up transformer.

As is appreciated by those familiar with the art the presence of the output transformer is undesirable for many reasons. Its presence adds significant bulk, weight and cost. This is due to the fact that the transformer requires a large heavy core of low-loss material, relatively few turns, and carefully controlled winding geometry, in order to enable it to withstand maximum voltage and power at low frequencies as well as operate at low loss at high power frequencies. In addition, and possibly more important, the need for an output transformer forces serious compromises in electrical output characteristics.

In the prior art power sources, the feedback signal is provided to the power amplifier from the transformer primary, which results in loss of regulation, distortion and transient response to the secondary winding to which the load, which is typically a non-linear load, often with a very low power factor, is connected. The load is actually a part of the circuit and affects the transformer output voltage. Theoretically, it would be desirable to stabilize the power source by providing feedback from the transformer secondary winding to which the load is actually connected, rather than from the primary winding. Such feedback, however, is not possible because of variable transformer phase shift with operating frequency and with load reactance variations. Thus, the feedback from the primary, rather than from the secondary, results in regulation loss. Due to the high phase shifts caused by the transformer leakage inductance and load capacitance most prior art power sources, using primary winding feedback, do not operate with any degree of satisfactory stability with loads of very low power factors.

In some power sources with an output transformer, open loop compensation is attempted. However, such compensation is itself feedback which often causes the circuit to oscillate. Practically all of these problems can be eliminated by the elimination of the output transformer and by providing feedback directly from the output terminals to which the non-linear load is actually connected.

OBJECTS AND SUMMARY OF THE INVENTION

It is a primary object of the present invention to provide a new solid state AC power source.

Another object of the present invention is to provide a new solid state AC power source characterized by the absence of an output transformer.

A further object of the present invention is to provide a transformerless solid state AC power source with direct feedback from the source's output terminals to which the load is connected.

A further object is to provide power modules which prevent failure propagation and thereby enable high reliability system configurations.

These and other objects of the invention are achieved by providing a power source with two (first and second) voltage amplifiers. The first voltage amplifier is associated with two current amplifiers, one outputting current in the one (positive) direction to one (first) output terminal, while the other current amplifier outputs current in the opposite (negative) direction to the first output terminal. Each of the current amplifiers is assumed to have unity voltage gain. The first voltage amplifier produces an AC (generally sine wave) output voltage with respect to a reference level, e.g., ground which is substantially ½ the desired output voltage of the power source. For example, assuming a desired output of 130v rms, the voltage output of the first voltage amplifier is substantially 65v rms. Therefore, the first terminal is capable of delivering rated output current at 65v rms. Feedback from the first output terminal is supplied directly to the first voltage amplifier to keep the output a low distortion replica of the voltage amplifier input.

The second voltage amplifier is similarly connected through two current amplifiers to the power source second output terminal at which rated output current is deliverable at 65v rms. Again to reduce distortion the signal at the second output terminal is fed back directly to the second voltage amplifier. The voltages at the two output terminals are 180° out of phase so that a load, connected across the two output terminals is provided with rated output current at $2 \times 65 = 130$v rms.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
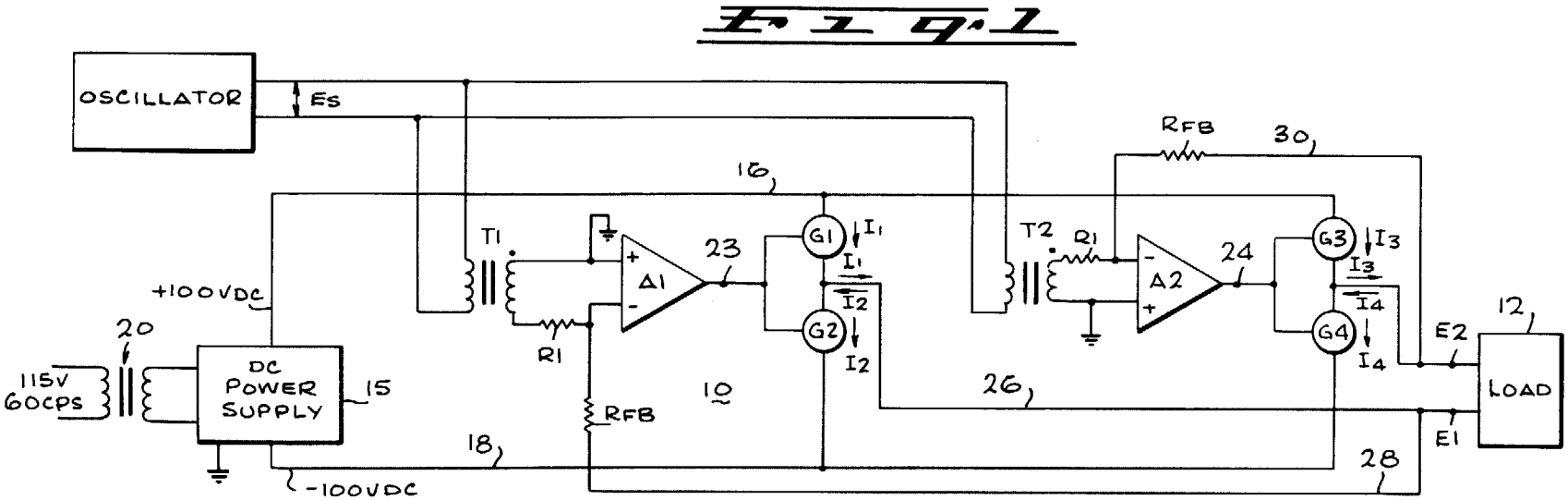
FIG. 1 is a basic block diagram of the present invention.

Attention is directed to FIG. 1 which is substantially a block diagram in connection with which the general aspects of the invention will be described. For explanatory purposes, it is assumed that the power source 10 is to provide power to a load 12, which is connected across output terminals E1 and E2 at rated output current, e.g., up to 8 amperes at 130v rms. The power source 10 includes a DC power supply 15, which provides +100v DC on line 16 and −100v DC on line 18 with respect to a reference level, e.g., ground. The power supply 15 may use regular incoming electrical power, such as 115v 60 cps supplied thereto through an input transformer 20.

The power source 10 includes an oscillator 22 which is assumed to provide an output voltage, designated $E_s$, at a selected frequency, e.g., 60 cps. Also included are two substantially identical wide-band voltage amplifiers A1 and A2, whose output terminals are designated 23 and 24 respectively, and which are driven by the oscillator output $E_s$ through substantially identical input transformers T1 and T2. Each voltage amplifier includes an input resistor R1. Direct feedback is provided to the input of A1 from output terminal E1 via line 28 and through a feedback resistor $R_{FB}$, while similar direct feedback is supplied from output terminal E2 to A2 via line 30 and an identical feedback resistor $R_{FB}$.

The open loop gain of each of voltage amplifiers A1 and A2 is generally very high, while its closed loop gain is established by the input resistor R1 and resistor $R_{FB}$. With R1 = 2k and $R_{FB}$ = 100k the closed loop gain of each of A1 and A2 is set at 50. As connected to the oscillator 22 through the transformers T1 and T2 the output voltages of A1 and A2 at output terminals 23 and 24 are 180° out of phase. For explanatory purposes at this point of the description it is assumed that the output voltage of each of A1 and A2 at terminals 23 and 24, respectively, is 65v rms, except that the voltages are 180° out of phase with respect to one another.

Each of voltage amplifiers A1 and A2 has two current amplifiers or drivers associated therewith. A1 is connected to current amplifiers G1 and G2 whose outputs are connected by line 26 to output terminal E1. Current amplifier G1 is connected to line 16 and is supplied with +100v DC, while current amplifier G2 is connected to line 18 and is supplied with −100v DC. Each of the two current amplifiers G1 and G2 has very high current gain with practically unity voltage gain. Thus, since the output voltage of A1 is assumed to be 65v rms and each of the current amplifiers has practically unity voltage gain, the voltage at output terminal E1 is 65v rms.

In operation the output of A1 turns on either current amplifier G1 or current amplifier G2. When current amplifier G1 is turned on by A1 it provides current in the positive direction to terminal E1, as represented by arrow $I_1$. Thus, G1 can be thought of as the positive current amplifier. When current amplifier G2 is turned on by A1 it provides current in the negative direction to terminal E2 as represented by arrow $I_2$. Thus, G2 can be thought of as the negative current amplifier. Since feedback is supplied to A1 directly from output terminal E1, to which the load 12 is connected, the operation of A1 together with G1 and G2 is fully stabilized, irrespective of the output current waveform. The output waveform is practically a replica (low distortion) of the oscillator output $E_s$, which is typically a sine wave and which is amplified by A1. As previously pointed out since each of the current amplifiers G1 and G2 has practically unity voltage gain the A1 output voltage is controlled so that the voltage at output terminal is 65v rms.

Similarly, the output of A2 is connected to current amplifiers G3 and G4, whose outputs are connected to the other output terminal E2. G3, to which the +100v DC is supplied, serves as the positive current amplifier to provide current in the positive direction to E2 as represented by $I_3$, when turned on by A2. G4, to which the −100v DC is supplied, serves as the negative current amplifier to provide current in the negative direction to E2 as represented by $I_4$. As will be described hereinafter each of the four current amplifiers G1–G4 includes a plurality of current amplifying transistors.

It should thus be appreciated that each unit, consisting of one voltage amplifier (such as A1) and two current amplifiers (such as G1 and G2), provides power at 65v rms at the rated output current at one of the output terminals (such as E1). Since the voltages at the output terminals 23 and 24 of A1 and A2 are 180° out of phase, the output voltage at E1 and E2 are also 180° out of phase, and since each is 65v rms the voltage applied to load 12, which is connected across E1 and E2 is 130v rms. Assuming that each of the current amplifiers is rated up to 8 amperes, the arrangement shown in FIG. 1 is capable of delivering about 1kVA power.

It should be pointed out that the output of 130v rms is achieved without a step-up output transformer, which is required in the prior art. Yet since the output voltage at each current amplifier is only 65v rms, the worst case of voltage stress to which the output transistors in the current amplifiers G1–G4 are subjected is less than 200 volts, thereby protecting them from second breakdown failure. Furthermore, since the feedbacks to A1 and A2 are taken from the output terminals E1 and E2, to which the non-linear load 12 is connected, the actual effects of the load are in the closed feedback loop, enabling the full stabilization of the power source 10 against oscillation even with a load with a very low power factor.

The arrangement shown in FIG. 1 lends itself to a modular design to provide high current capacity requirements with a very high degree of reliability. This aspect of the invention may best be explained in connection with FIG. 2. Therein C represents one current module consisting of four current amplifiers G1–G4, while D represents another current module consisting of another group of four current amplifiers G1–G4. As seen, the two modules C and D are connected in parallel between the outputs of A1 and A2 and the output terminals E1 and E2. The current amplifiers G1 and G2 of each module are connected to terminal 23 of A1 and their outputs are connected to output terminal E1, while the current amplifiers G3 and G4 of each module are connected to output terminal 24 of A2 and their outputs to output terminal E2. Assuming that the current rating of each module is 8 amperes, since the modules are driven in parallel, with a voltage output of 130v rms each module has a 1kVA rating for a total power source rating of 2kVA.

As shown, the outputs of the various current amplifiers are connected to output terminals E1 and E2 through protective fuses 32 while their connections to the outputs of the voltage amplifiers A1 and A2 are through disconnect circuits 35. The function of fuses 32 is to prevent above rated current from being delivered by any module in the event of module malfunctioning. The function of the disconnect circuits 35 is to automatically disconnect a module from the voltage amplifiers upon sensing a malfunction in any of the modules, and thereby prevent the voltage amplifiers from being improperly loaded by a malfunctioning module. As will be explained hereinafter in greater detail, each disconnect circuit 35 in a sense limits the current drain on each voltage amplifier by the current amplifiers of each module not to exceed a tolerable limit, so that the malfunctioning of any current amplifier of any module does not affect the proper driving of the current amplifiers of the other modules. It should be pointed out that since in the present invention the feedbacks to the voltage amplifiers A1 and A2 are taken directly from the output terminals E1 and E2, as long as one module is functioning, properly closed loop feedback is provided, and thereof power is suppliable to the load 12.

The modular design of the present invention is most significant for use with equipment requiring very high degrees of operation reliability, e.g., complex computer systems, or hospital equipment. For such systems, in the prior art, quite often two power sources are purchased, one serving as a standby source, which is switched in, when the other power source fails. Having to purchase two units is most undesirable since large power sources are very expensive. Also, in some applications in which continuous operation is a must the time consumed in switching from one power source to another is too long to be permissible. If automatic transfer is employed, the transient created is also undesirable and intolerable in many applications.

The present invention with the modular design eliminates these problems. In accordance with the present invention the current modules are designed as plug-in units, to provide variable power rating with a very high degree of reliability. For example, for a 10kVA source 10 modules, such as C and D, each rated at 8 amperes, are connected in parallel between A1 and A2 and output terminals E1 and E2. The failure of any one module merely reduces the deliverable power to 9kVA, rather than causing a complete power delivery failure. The failure is sensed by appropriate indicators, associated with each module. Once a module fails it is easily replaced with another plug-in module. The entire module replacement time is minimal, generally on the order of a few minutes.

It should be stressed, however, that even during the replacement time, power supply to the load is not interrupted, but is merely reduced by the amount of rated currents of the module being replaced. Thus, with the modular power source of the present invention the need for an expensive stand-by power source is eliminated. Furthermore, the interruption of power supply to the load which takes place during the time the standby power source is switched in, as is the case in the prior art, is entirely eliminated.

Figure 3:
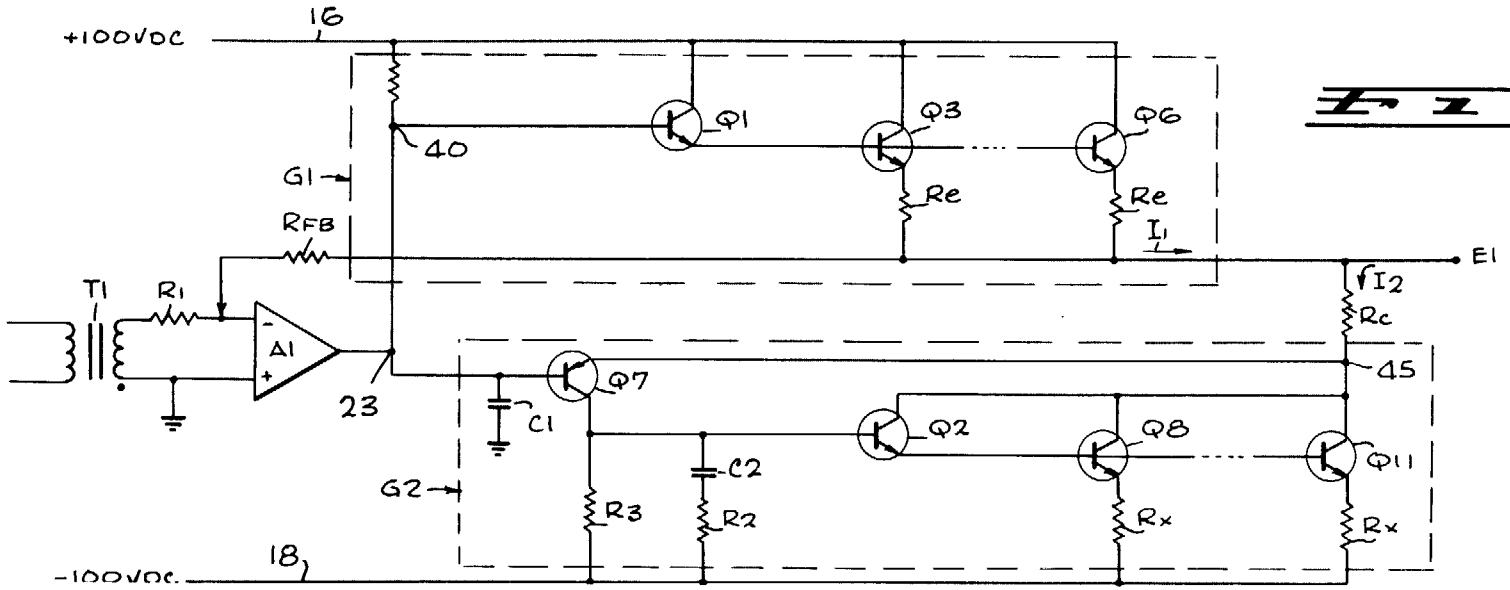
FIG. 3 is a diagram of an embodiment of positive and negative current amplifiers forming one-half of a current module and driven by a voltage amplifier in accordance with the present invention.
Figure 2:
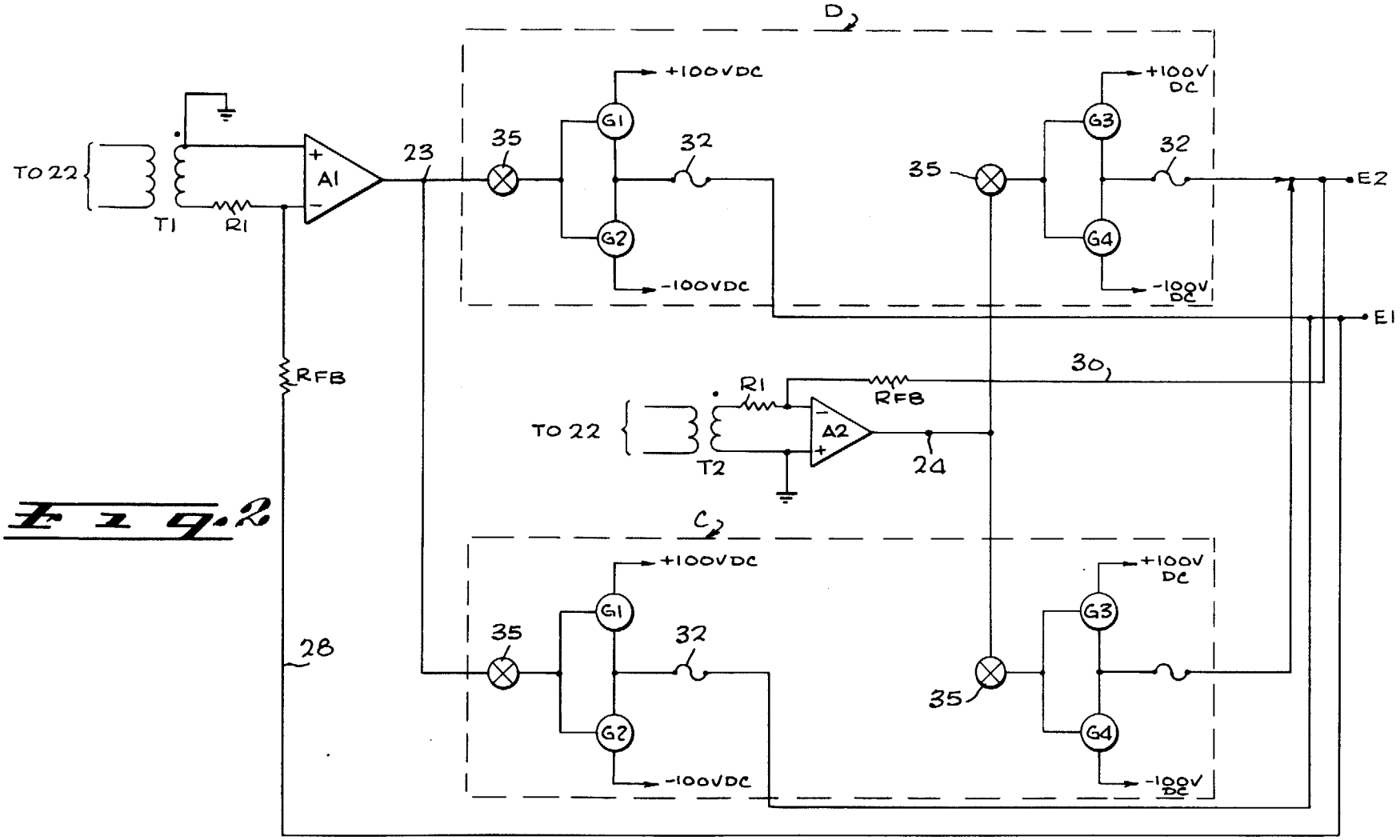
FIG. 2 is a partial block diagram useful in explaining a multi-module embodiment of the invention.

Attention is now directed to FIG. 3 wherein the current amplifiers or drivers G1 and G2 which form one half of a current module are shown connected to voltage amplifier A1. As is appreciated from the prior description each current module also includes current drivers G3 and G4 which are respectively identical to G1 and G2 and which are connected to A2 to provide the rated current at one half the desired output voltage to the other output terminal E2. As shown in FIG. 2 in a multimodule system G1 and G2 of each module are connected to A1 through a separate disconnect circuit 35 and similarly G3 and G4 of each module are connected to A2 through a separate disconnect circuit 35. For explanatory purposes, however, the disconnect circuit between A1 and G1 and G2 is not shown in FIG. 3. It will be described hereinafter in connection with FIG. 4.

As shown in FIG. 3 the positive current driver G1 consists of an NPN transistor Q1 whose base is driven by the output of A1. The positive current driver G1 also includes a plurality of NPN transistors Q3–Q6 which are connected in parallel as emitter followers and which serve as positive current amplifiers, when driven in parallel by Q1. A separate resistor $R_e$ is shown connected between the emitter of each of Q3–Q6 and the output terminal E1. Although in FIG. 3 only four transistors Q3–Q6 are shown connected in parallel, in practice more than four such transistors are included, to provide the load 12 with positive current up to the rated current, assumed for explanatory purposes to be 8 amperes.

When the output current to the load is positive, as represented by arrow $I_1$, i.e., current flows to the load, A1 turns Q1 ON which in turn drives the current amplifier transistors Q3–Q6 to supply the load with the positive current to terminal E1. During the time that the positive current driver G1 is turned ON and positive current $I_1$ is applied to the load, the negative current driver G2 is turned off.

The negative current to the load (in the negative direction), as represented by arrow $I_2$, is provided by the negative current driver G2. Normally it would be desirable to incorporate in G2 a symmetrical design to that of G1. However, instead of the NPN transistors Q1 and Q3–Q6 of G1, G2 would include PNP transistors, operating as emitter followers to conduct the negative current $I_2$. However, the present state of semiconductor technology does not offer PNP transistors with the desired power characteristics. Therefore, in accordance with the present invention G2 is implemented with a lower power PNP transistor Q7 and high power NPN transistors Q2 and Q8–Q11, connected in such a fashion as to simulate a power PNP emitter follower circuit, which is generally referred to as a "quasi-PNP" circuit. In G2 transistors Q2 and Q8–Q11 function in a manner analogous to that of Q1 and Q3–Q6 in G1.

As seen from FIG. 3, G2 includes a small resistor $R_e$ connected between output terminal E1 and a junction point 45 to which the emitter of PNP transistor Q7 and the collectors of Q2 and Q8–Q11 are connected. The base of Q7 is connected to the output of A1 and the collector is connected to −100v DC on line 18 through a loop-gain-determining resistor R3, and to the base of Q2. Q2 acts as the driving transistor for Q8–Q11, each of which is connected to the −100v DC line 18 through a separate resistor $R_x$.

In operation to provide the positive current $I_1$ the output voltage of A1 is slightly higher than that at output terminal E1 so as to overcome the accumulated base to emitter voltage drops of Q1 and Q3–Q6 which is about 1 volt, plus the voltage drop caused by the current flow through $R_e$, which is also about 1 volt at full load of 8 amperes. Similarly, when negative current $I_2$ is provided, i.e., G2 is turned ON, the output voltage of A1 must overcome the base to emitter voltage of Q7 plus the voltage drop across $R_e$, which at full load of 8 amperes is about 1 volt. Thus, the output of A1 must be approximately 67 volts in order to obtain 65 volts at output terminal E1. However, for explanatory purposes each of current drivers G1 and G2 can be assumed as having unity voltage gain and that the output voltage of A1 is substantially the same as the voltage at the output terminal E1, i.e., 65v rms assumed herein for explanatory purposes.

To provide the negative current $I_2$, A1 turns on transistor Q7 and therefore a small current is drawn from terminal E1 through resistor $R_c$, through Q7 and the resistor R3, resulting in a positive voltage at the base of Q2. The positive drive at Q2 drives parallel transistors Q8–Q11, causing a large negative current to flow from E1 through $R_c$ and Q8–Q11 to the −100v DC line 18. Q7, Q2 and Q8–Q11 have sufficient current gain so that a small amount of current drive at the base of Q7, e.g., 1ma cause a large current e.g., 8 amperes to flow through Q8–Q11. Thus, Q7 together with NPN transistors Q2 and Q8–Q11 simulate a negative current driver of cascaded PNP emitter followers, even though Q2 and Q8–Q11 are NPN transistors, connected as emitter followers.

Although G2 as shown is functionally similar to a PNP emitter follower it is in fact a feedback circuit with high current gain. This circuit can oscillate at high frequencies where the phase shift is in excess of 180° and loop voltage gain is unity. In order to eliminate the possibility of oscillation, a pole-zero network is added in the form of a resistor R2 and a capacitor C2 connected in series across resistor R3, which together with emitter resistors $R_e$ determine the loop gain. The function of this pole-zero network is to smoothly reduce the shape and frequency response, so that the loop gain is reduced safely below unity before phase shift reaches 180°. Minimization of phase shift to prevent oscillation is further aided by a capacitor C1, which is connected between the base of Q7 and ground. Capacitor C2 serve as a low impedance for the base of Q7 at high frequencies, in order to minimize the phase shift contribution from Q7.

As previously stated the current amplifiers G1 and G2, shown in FIG. 3, form only one half of a current module. The other half consists of current amplifiers G3 and G4, which are respectively identical to G1 and G2, but which are driven by voltage amplifier A2 to provide up to the rated current to the other output terminal E2.

As previously indicated, the arrangement, shown in FIG. 3, does not include the disconnect circuit 35 between the voltage amplifier A1 and current drivers G1 and G2. As pointed out in connection with the description of FIG. 2, the single voltage amplifier A1 can drive in parallel the current drivers G1 and G2 of several modules, such as C and D. In such a multi-mode arrangement each pair of drivers G1 and G2 of each module has to be connected to A1 through a separate disconnect circuit 35 so that in case of failure of one module, A1 is not affected and is capable of properly driving the drivers G1 and G2 of the properly-functioning modules. A similar disconnect circuit 35 has to be provided between A2 and the current drivers G3 and G4 of each module.

Figure 4:
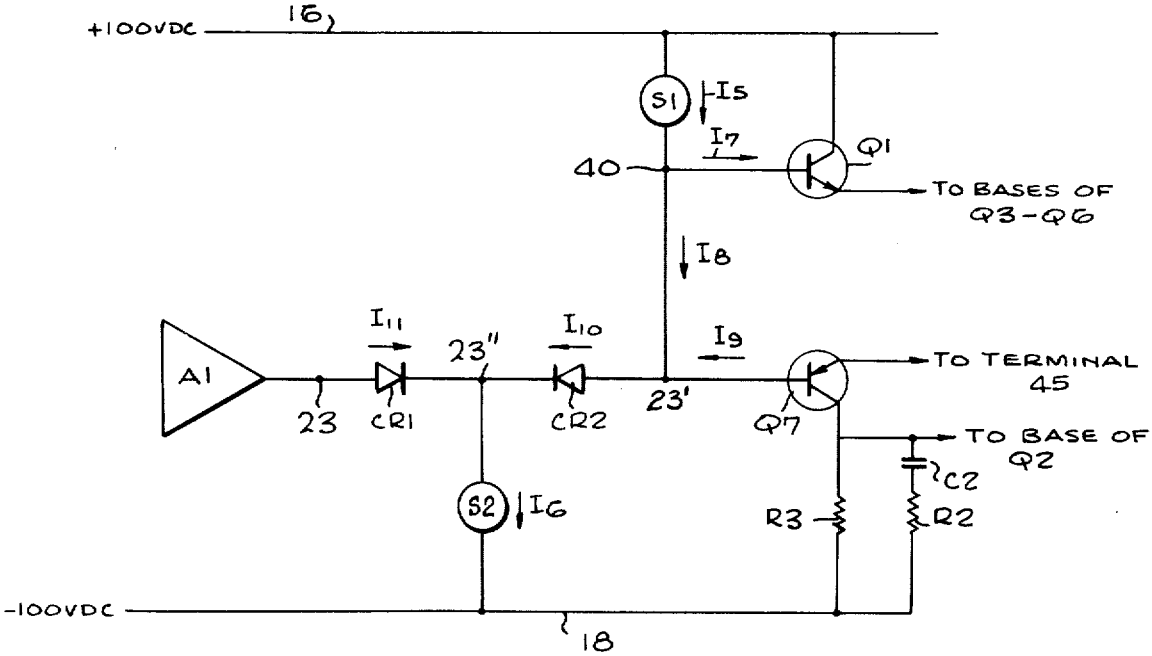
FIG. 4 is a diagram of one embodiment of a disconnect circuit.

Attention is now directed to FIG. 4 in connection with which one embodiment of the disconnect circuit 35 connected between A1 and G1 and G2 of one module will be described. It should however be appreciated that different circuit arrangements may be used in the actual implementation of the disconnect circuit 35. As shown in FIG. 4, the disconnect circuit 35 consists of a pair of diodes CR1 and CR2 and constant current sources designated S1 and S2.

The two diodes CR1 and CR2 are connected between the output terminal 23 of A2 and a terminal 23' to which G1 and G2 are actually connected, while constant current source S2 is connected to a junction point 23'' to which the two diodes are connected and to the −100v DC line 18. Constant current source S1 is connected between the +100v DC line 16 and a junction point 40 to which the base of Q1 of G1 is connected, as well as the terminal 23'.

Under normal operating conditions both diodes CR1 and CR2 are in conduction and ignoring any mismatch in their forward voltage drops the voltage at terminal 23' is the same as that at outut terminal 23 of A1.

For explanatory purposes the following assumptions are made: S1 is set for a current $I_5$=2ma, S2 is set for a current $I_6$=5ma, for maximum positive output current $I_1$ the required base current for Q1, designated $I_7$=1ma and for maximum negative output current $I_2$, the base current for Q7 designated $I_9$ = 1ma. The currents through diodes CR1 and CR2 are respectively designated by $I_{11}$ and $I_{10}$ and the current between terminals 40 and 23' is $I_8$.

From FIG. 4 it should be apparent that $I_8=I_5-I_7$, $I_{10}=I_8+I_9$ and that $I_6=I_{11}+I_{10}$. During maximum positive current output $I_7$=1ma and $I_9$=0. Therefore, $I_8$=2−1=λ 1ma and $I_{10}$=1+0=1ma. On the other hand, when maximum negative current output is drawn $I_7$=0 and $I_9$ = 1ma. Therefore, $I_8$=2ma and $I_{10}$=2+1=3ma. Thus, under normal operations $I_{11}$ which is the current through diode CR1 varies between 0.2ma and 4ma.

Any failure in G1 and/or G2 affects the current $I_{10}$ to be outside its boundaries (between 1ma and 3ma) which are present under normal conditions. For example, if the failure is of a positive nature which increases $I_{10}$ from 3ma up to 5ma, $I_{11}$ would drop to zero since $I_{11}=I_6-I_{10}$=5−5=0, thereby back-biasing CR1 which effectively disconnects A1 from G1 and G2. On the other hand, if the failure is of a negative nature, so that $I_{10}$ drops to 0ma, $I_{11}$ would be equal to $I_6$ which is equal to 5ma. Thus, the maximum current drain to which A1 may be subjected is 5ma.

At present, voltage amplifiers capable of current output of tens of ma, e.g., 50ma or more are available. Thus, since the maximum load to which the amplifier A1 is subjected, even under fail condition, is limited to 5ma, a large number of modules can be connected in parallel to be driven by the single voltage amplifier A1. With the present invention, assuming each module draws up to 4ma from A1 under normal conditions and are not more than 5ma under failure conditions, up to 10 modules can be connected to A1 which is capable of delivering 50ma output current, without being overloaded.

It should be appreciated that only the failure of the disconnect circuit 35 itself can cause excessive loading of A1. However, diodes such as CR1 and CR2 with very high reliability are available and constant current sources, such as S1 and S2, can be designed with very high reliability parts so that the entire disconnect circuit 35 can be made to be practically fail-proof. With such fail-proof disconnect circuits excessive loading of A1 due to module failure can be practically eliminated. It should be appreciated that for each module another disconnect circuit 35 is included between A2 and the module's current drivers G3 and G4. In general terms the disconnect circuit 35 can be thought of as a circuit for limiting the current load applied to the output of a voltage amplifier to which positive and negative current amplifiers, capable of being driven by the voltage amplifier, not to exceed a predetermined limit, which in the above example is 5ma, upon the failure of either or both current amplifiers.

As seen from FIG. 3, in G1 the current-amplifying emitter follower transistors Q3–Q6, which are base driven by base current from the emitter of Q1, are connected in parallel between the +100v DC on line 16 and output terminal E1. The problem which may arise from such a parallel connection is that failure of one of these transistors, due to a collector-to-emitter short or base-collector short, may drastically effect the performance of the remaining transistors. If a transistor, such as Q3, fails by a collector-emitter short, excessive current will flow through Q3, limited only by the emitter resistor $R_e$. On the other hand, a collector-base short is destructive because current will flow through the collector-base short, thereby resulting in excessive base drive to all the other transistors. The only nondestructive failure is an open transistor, which does not load down the base drive.

These problems are present whenever a plurality of base driven common emitter or common collector transistors are connected in parallel. In accordance with the present invention these problems are overcome by inserting a fuse between each emitter and the line to which all the emitters are to be connected and by inserting a diode between each transistor base and the line on which the base drive current is provided.

Figure 5:
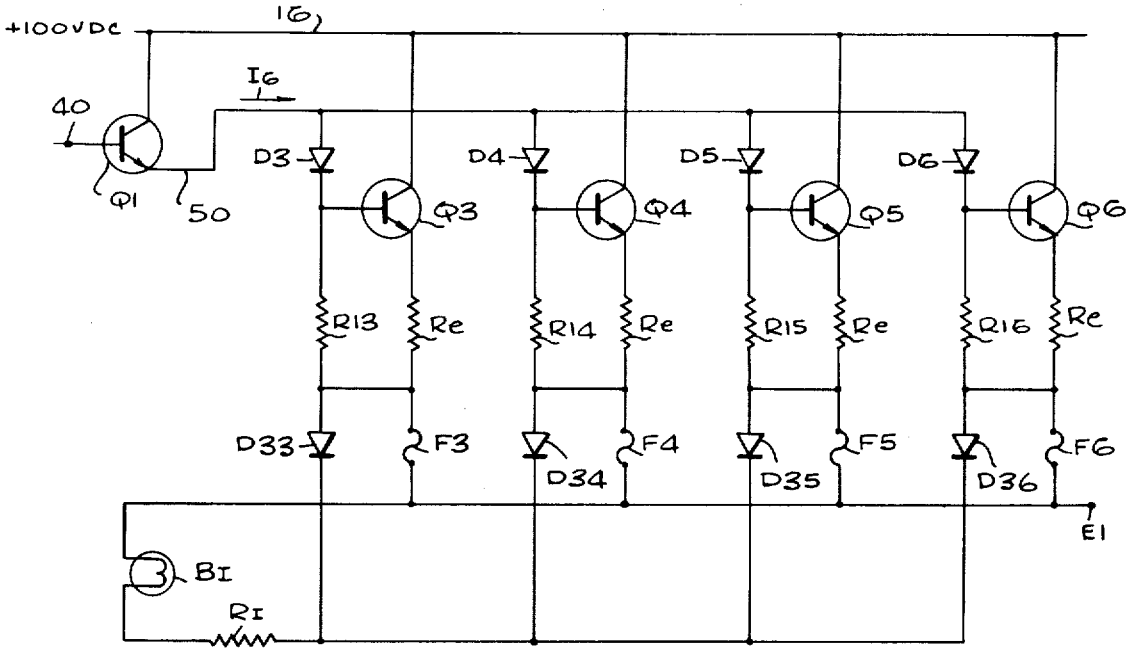
FIG. 5 is a schematic diagram useful in explaining a protection circuit for parallel-connected commonly driven transistors.

This aspect of the invention may best be described in connection with FIG. 5 in which Q3–Q6, driven with base current $I_b$ from the emitter of Q1 are shown. Instead of directly connecting the emitter resistors $R_e$ of the transistors Q3–Q6 to output terminal E1, fuses F3–F6 are inserted in each emitter leg between $R_e$ and E1. Each of the fuses is rated slightly above the maximum normal current for each transistor. Also included are diodes D3–D6 which are inserted between the base of each of Q3–Q6 and the common base line 50 which is connected to the emitter of driving transistor Q1.

In operation, if any of the transistors Q3–Q6 fails in the form of a collector-to-emitter short, or a collector-to-base short, excessive current would flow through the fuse F3. Consequently, fuse F3 will blow out thereby breaking the current path. Due to a collector-to-base short in Q3 excessive current flow from the collector to the base of Q3 and therefrom to the bases of the other transistors will be blocked by the diode D3, which is in series with the base of Q3. Upon the occurrence of a collector-to-base shoft in Q3, D3 will become back biased by the higher collector voltage, thereby preventing excessive turn-on of the other transistors. It should thus be appreciated that the incorporation of the fuses (F3–F6) and the diodes (D3–D6), a short-type failure of any of the transistors does not adversely effect the other properly-functioning transistors. These fuses and diodes may be thought of as a protection circuit for transistors whose collector to emitter paths are connected in parallel and whose bases are commonly driven by base current on a common line.

If desired resistors R13–R16 may be incorporated, each connected between the transistor base and the transistor emitter or to the junction point of the emitter resistor $R_e$ and the fuse. The function of each of these resistors R13–R16 is to cause a small current to flow through each base diode and thereby keep the diode dynamic resistance to a low value.

If desired a transistor failure-indicating arrangement may be incorporated to indicate a transistor failure which results in a fuse blow out. Such a failure-indicating arrangement may comprise diodes D33–D36, a relatively large resistor $R_l$ and an indicator, such as a bulb $B_l$. Upon the blow out of any fuse, such as F5, due to the failure of Q5, high current will flow through diode D35 and $R_l$ to illuminate $B_l$. However, as long as none of the fuses is blown out the currents flowing through diodes D33–D36 due to the large resistance of $R_l$ would be insufficient to illuminate $B_l$. It should be stressed that when $B_l$ is illuminated it indicates that one of the transistors Q3–Q6 failed and its associated fuse blew out. It does not however, indicate which of the transistors is the one that failed.

It should be apparent that a similar arrangement of the protection circuit with the transistor failure-indicating arrangement may be incorporated in the parallel connected transistors Q8–Q11 of G2, as well as, in the parallel connected transistors of G3 and G4, which together with G1 and G2 form a single current module. In such an embodiment each module will have four bulbs $B_l$ so that when any of them is illuminated it would indicate a failure of one of the transistors in one of the four current amplifiers G1–G4. Such a failure-indicating arrangement is particularly advantageous in the multi-modular embodiment, previously described in connection with FIG. 2. The illumination of any bulb, associated with any current module, would alert an operator to replace the malfunctioning current module with another plug-in module. As previously indicated since all current modules (such as C and D) are connected in parallel between the voltage amplifiers A1 and A2 and the output terminals E1 and E2, as long as one module functions properly, power to the load is not interrupted during module replacement.

In addition, each current module may include one or ammeters (not shown) to monitor the current provided by the various current amplifiers G1–G4, of the module. In case any of these amplifiers malfunctions so that it becomes disconnected from its driving voltage amplifier by means of the disconnect circuits 35, as previously explained in connection with FIG. 4, the reading on the ammeter will be outside the normal range thereby indicating module failure and the need for its replacement.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. An alternating current (AC) power source for supplying AC power to a load at a selected voltage rating up to a selected current rating, the power source comprising:

first and second output terminals across which said load is to be connected;

first means including first voltage means and first current-amplifying means connected between said first voltage means and said first output terminal for providing at said first output terminal AC power at a voltage which is half said selected voltage rating up to said selected current rating, said first means including first feedback means for providing directly a feedback signal from said first output terminal to said first voltage means;

second means including second voltage means and second current amplifying means connected between said second voltage means and said second output terminal for providing at said second output terminal AC power at a voltage which is half said selected voltage rating, and which is 180° out of phase with respect to the voltage at said first output terminal, and up to said selected current rating, said second means including second feedback means for providing directly a feedback signal from said second output terminal to said second voltage means;

each of said first and second current amplifying means including a plurality of parallel connected common base driven current amplifying transistors; and protective means included in at least one of said current amplifying means for protecting the parallel connected transistors from a short failure in one of said parallel connected transistors.

2. The power source as described in claim 1 wherein said protective means include fuse means associated with said parallel connected transistors for interrupting the path of current flow through any of said transistors having a collector-to-emitter short.

3. The power source as described in claim 2 wherein said protective means include diode means coupled to the bases of said parallel transistors for preventing excessive base current drive to said transistors due to a collector-to-base short of one of said transistors.

4. The power source as described in claim 1 wherein said power source further includes oscillator means for providing an output at a preselected frequency and means for applying the oscillator means output to said first and second voltage means whereby their voltage outputs are 180° out of phase with respect to one another, said first current amplifying means including a first positive current amplifier and a first negative current amplifier which are respectively responsive to the output voltage of said first voltage means for respectively applying positive and negative currents to said load through said first output terminal, and said second current amplifying means including a second positive current amplifier and a second negative current amplifier which are respectively responsive to the output voltage of said second voltage means for respectively applying positive and negative currents to said load through said second output terminal.

5. The power source as described in claim 4 wherein each of said positive current amplifiers comprises a plurality of parallel connected common base driven NPN transistors with their collectors connected to a source of positive DC voltage and their emitters connected through separate emitter resistors and fuses to said output terminals, said fuses forming part of said protective means and diodes separately connected between the base of each of said transistors and a line on which base current is commonly supplied to said parallel connected transistors, said diodes forming part of said protective means, each fuse limiting the flow of current through the transistor with which it is associated not to exceed a selected level by interrupting the current path when said level is exceeded and each diode becoming back biased due to a collector-to-base short of the transistor with which it is associated to prevent excessive base driven current to the other parallel connected transistors.

6. The power source as described in claim 5 further including separate failure-indicating means coupled to each of said positive current amplifiers for providing an indication whenever any of said fuses interrupts the current path so as to prevent the current through one of said transistors from exceeding said selected level.

7. The power source as described in claim 5 wherein each of said negative current amplifiers is a quasi PNP circuit including a plurality of parallel common base driven NPN transistors and input means including a PNP transistor for turning said NPN transistors to conduct negative current between each of said output terminals which is directly connected to said load and a line at a selected negative DC potential.

8. An alternating current (AC) power source for supplying AC power to a load at a selected voltage rating up to a selected current rating, the power source comprising:

first and second output terminals across which said load is to be connected;

first means including first voltage amplifying means and $n$ first current amplifying means, $n$ being an integer not less than two, connecting means for connecting said $n$ first current amplifying means in parallel between said first voltage amplifying means and said first output terminal to provide thereat power at half said voltage rating and up to said selected current rating, each of said $n$ first current amplifying means being adapted to provide up to $1/n$ of said selected current rating, said connecting means including $n$ separate disconnect means for effectively disconnecting any malfunctioning one of said $n$ first current amplifying means from said first voltage means, without affecting the connection between said first voltage means and the rest of said first current amplifying means, and feedback means for providing a direct feedback signal from said first output terminal to said first voltage amplifying means; and second means including second voltage amplifying means and $n$ second current amplifying means, connecting means for connecting said $n$ second current amplifying means in parallel between said second voltage amplifying means and said second output terminal to provide thereat power at half said voltage rating and up to said selected current rating, each of said $n$ second current amplifying means being adapted to provide up to $1/n$ of said selected current rating, said connecting means including $n$ separate disconnect means for effectively disconnecting any malfunctioning one of said $n$ second current amplifying means from said second voltage means, without affecting the connection between said second voltage means and the rest of said second current amplifying means, and feedback means for providing a direct feedback signal from said second output terminal to said second voltage amplifying means, the voltage provided by said second means at said second output terminal being 180° out of phase with respect to the voltage provided by said first means at said first output terminal.

9. The power source as described in claim 8 wherein said first voltage amplifying means is characterized by an output current rating of not less than a selected value, definable a $m$, and each of said disconnect means of said first means including means for effectively disconnecting a malfunctioning first current amplifying means from said first voltage amplifying means by limiting the current drawn from said first voltage amplifying means not to exceed a current value definable as $m/n$.

10. The power source as described in claim 8 further including oscillator means for providing an output at a preselected frequency and means for supplying the oscillator means output to said first and second voltage amplifying means whereby the output voltages of said first and second voltage amplifying means are 180° out of phase with respect to one another.

11. The power source as described in claim 10 wherein each first current amplifying means includes a positive current amplifier for providing positive current up to $1/n$ of the rated current to said load through said first output terminal and a negative current amplifier for providing negative current up to $1/n$ of the rated current to said load through said first output terminal, and each second current amplifying means includes a positive current amplifier for providing positive current up to $1/n$ of the rated current to said load through said second output terminal and a negative current amplifier for providing negative current up to $1/n$ of the rated current to said load through said second output terminal.

12. The power source as described in claim 11 wherein each positive current amplifier includes a plurality of common base driven parallel connected NPN transistors and protective means associated with said transistors for limiting the current flow in the collector to emitter path of each transistor not to exceed a selected current level and for protecting said parallel NPN transistors from excessive base current due to a collector-to-base short of any of said transistors.

13. The power source as described in claim 12 wherein said protective means includes a separate fuse in series with the collector to emitter path of each of said parallel connected NPN transistors, said fuse breaking the current flow path when the level of current in the collector to emitter path exceeds said selected current level, and said protective means including a separate diode connected between the base of each transistor and a line on which base current is supplied in common to said transistors, the diode becoming back biased when the transistor to which it is connected is characterized by a collector-to-base short.

14. The power source as described in claim 13 further including means for providing an indication whenever any of said fuses breaks the path of current flow in the collector to emitter path of the transistor with which it is associated.

* * * * *